United States Patent [19]

Bellagamba et al.

[11] Patent Number: 4,852,881

[45] Date of Patent: Aug. 1, 1989

[54] GOLF TRAINING APPARATUS

[76] Inventors: Miro D. Bellagamba, 13140 Lake Mary Jane Rd., Orlando, Fla. 32832; Richard L. Ohly, 3000 S. Semoran Blvd., Apt. 7, Orlando, Fla. 32822

[21] Appl. No.: 248,592

[22] Filed: Sep. 26, 1988

[51] Int. Cl.[4] ..... A63B 69/36

[52] U.S. Cl. ..... 273/183 B; 273/191 A; 273/190 R; 273/192

[58] Field of Search ..... 273/183 B, 188 R, 188 A, 273/189 R, 189 A, 190 R, 190 A, 190 B, 191 R, 191 A, 191 B, 192

[56] References Cited

U.S. PATENT DOCUMENTS

| | | | |
|---|---|---|---|
| 3,730,531 | 5/1973 | Zega | 273/191 A |
| 3,744,799 | 7/1973 | Hightower | 273/191 A |
| 4,593,909 | 6/1986 | Anselmo et al. | 273/188 R |
| 4,659,084 | 4/1987 | Vuick | 273/188 R |

*Primary Examiner*—George J. Marlo

*Attorney, Agent, or Firm*—William M. Hobby, III

[57] ABSTRACT

A golf training apparatus has a frame having a base for sitting on the ground and a first golf club swing guide attached to the frame for guiding a person's swing of a golf club. A guide adjustment system allows for the adjustment of the position of the first golf club swing guide as to both height and tilt of the guide. A second golf club guide is removably attachable to the first golf club swing guide and rigidly held thereto for guiding a persons swing and is adjusted by the adjustment of the first golf club swing guide to allow for a smaller size person or club to be utilized with the golf training apparatus. A putter attachment can be used for guiding a putter and waist and wrist attachments help provide complete swing training for a golfer. The frame and swing guides may be made of a PVC pipe and may have special PVC attachments utilizing standard PVC couplings. Adjustments are made by telescoping the pipe to the desired position and locking them in place.

17 Claims, 3 Drawing Sheets

FIG. 1
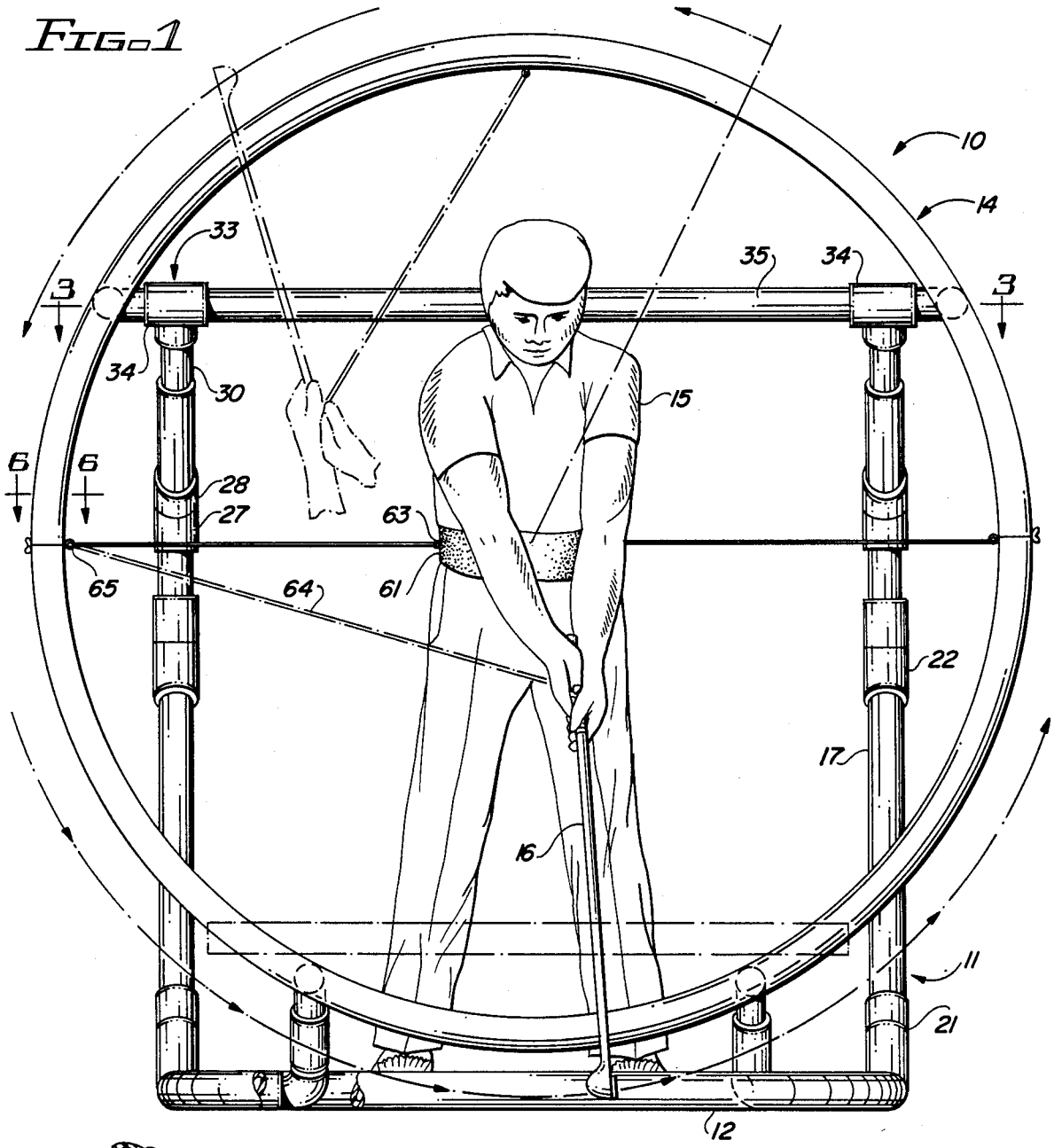
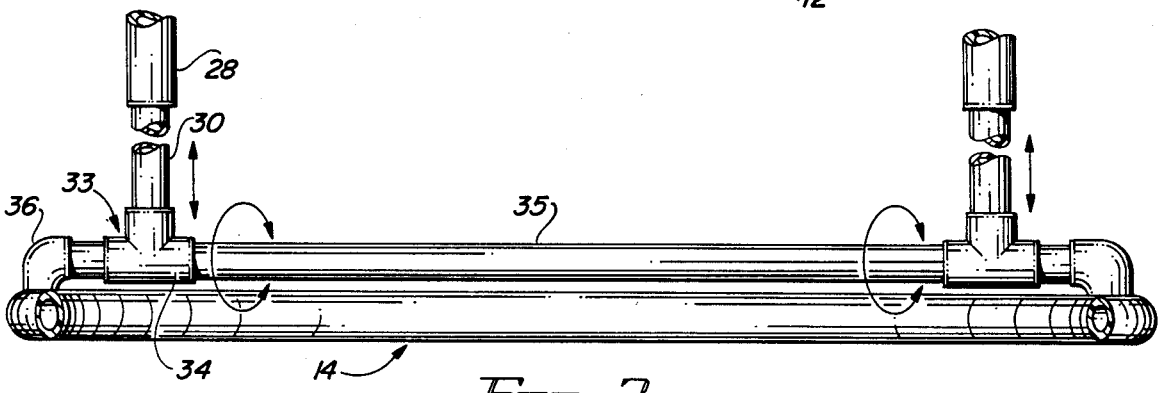
FIG. 3

FIG. 6
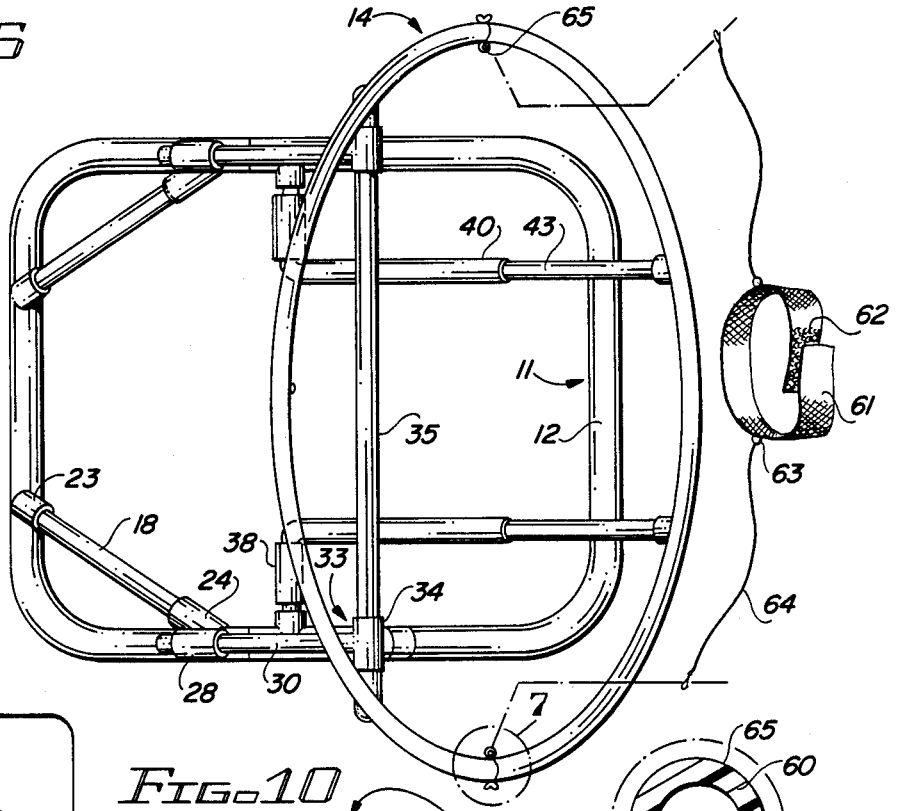
FIG. 7
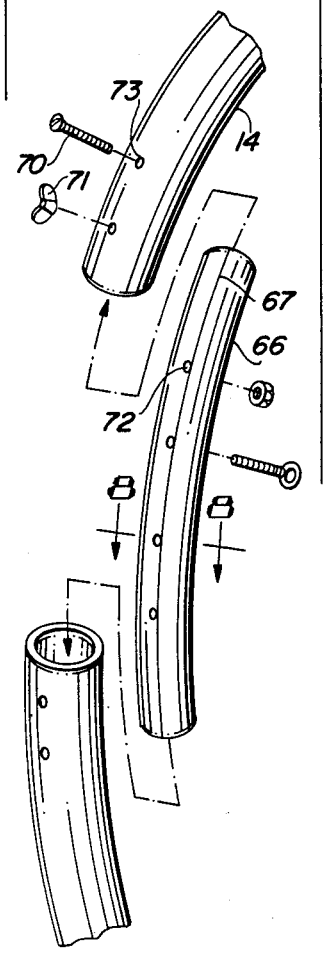
FIG. 10
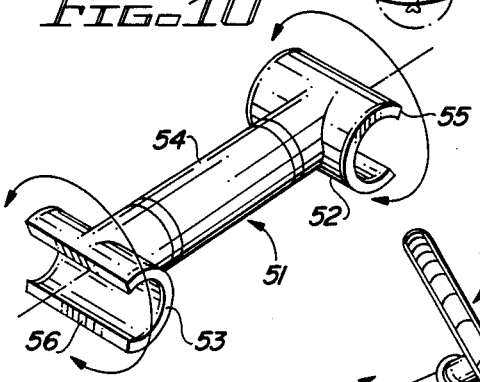
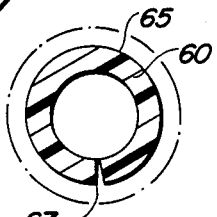
FIG. 8
FIG. 9
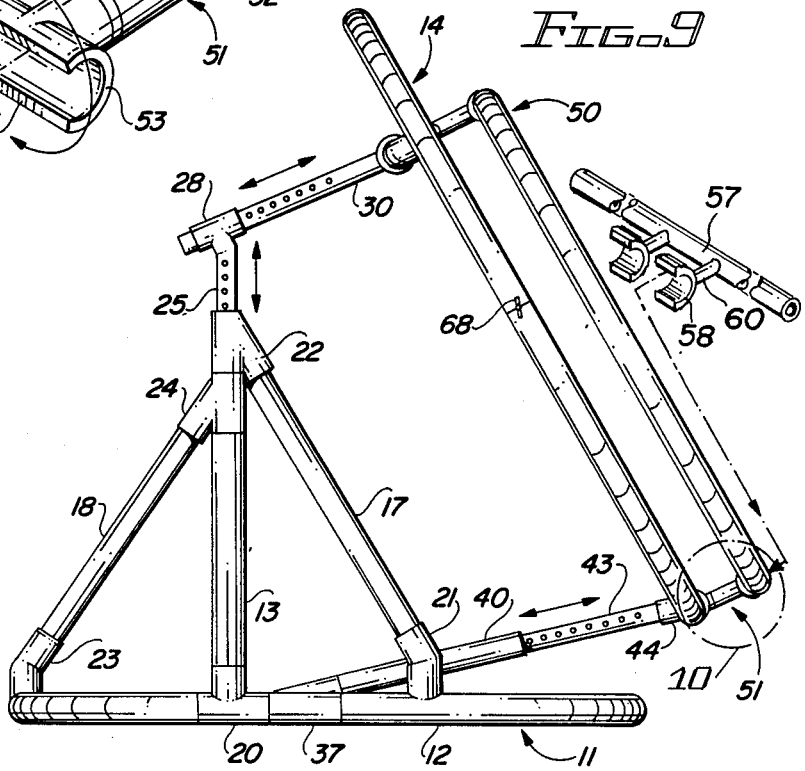

GOLF TRAINING APPARATUS

BACKGROUND OF THE INVENTION

The present invention relates to a golf training apparatus and especially to a golf training apparatus for guiding the swing of a golf club.

Proper striking of a golf ball requires more than a simple swinging motion of the golf club. Numerous factors come into play, any one of which, if improperly executed can cause a poor golf shot. A proper address of the ball by the player, proper grip of the club, proper body position and proper swing of the golf club are four of the key variables that must be correctly executed to achieve a good shot. If, however, the player properly addresses the ball, properly grips the club and assumes the correct body position, an erroneous shot can still result due to improper swing of the golf club. Further in this regard, if one does not swing the golf club properly, the golfer's head can be forced into movement, the club head can be pulled out of proper alignment with the golf ball, the body can be forced into an incorrect position, and the like. Any one of these errors could spell disaster to the shot. It is therefore, quite essential that the player properly swing the golf club. In fact, a properly swung club can force one to meet other criteria that are necessary for the successful golf shot. The correct swing of the golf club is therefore very important to a successful execution of the golf shot whether off the tee, on the fairway, out of a sand trap, or the like.

The ranks of golf professionals, and low handicap amateurs are said to have "grooved" their swings. This statement, of course, refers to the fact that these individuals have mastered a correct swing of the golf club according to their individual physical makeup, so that swinging of the club in the proper manner is a natural reaction. Hence the proper address is made, the club head is smoothly carried away from the ball in the proper arc, properly brought down into engagement with the ball and guided into a proper follow through after striking the ball. Each of these steps are accompanied by proper body action and reaction. In the "grooved" swing, one continually executes these functions as a natural event with a close degree of accuracy whereby a large majority of shots are consistent and predictable.

Throughout golf history, numerous items have been devised to facilitate education or instruction of a golfer in the art of stance, club grip, body movement, swing of the club and the like. In fact, numerous teaching aids have heretofore been devised for instructing one in the proper swing of a golf club. Such devices provide means to compel the individual to swing the club along a predetermined arc or plane. In general, these devices have utilized varying geometric swing paths for both back swing and follow through. A majority of these devices provide a slide or the like, secured to the apparatus and designed to receive a real or simulated club and follow the particular predetermined swing path. Numerous shaped swing paths have been shown in the prior art.

The present invention teaches a swing of a golf club utilizing a combination of methods incorporated into a single multi-purpose swing training system which can guide a swinging club of different size individuals and different size clubs without having a variety of different sized training devices. It simultaneously provides training for the use of the putter, the positioning of the waist and the wrist and arms during the swing.

Typical prior U.S. Patents which are pertinent to the present invention includes the Plunkett et al U.S. Pat. No. 2,520,287 which shows a golf club guiding device which captures a golf club and holds it in position for a spiral like swing. The Zega U.S. Pat. No. 2,653,025 is for a mechanical golf instruction aid which captures the golf club and holds it for a predetermined swing. The Plunkett et al U.S. Pat. No. 2,713,491 is a golf club guiding device for guiding the club in a predetermined manner. The MacStocker U.S. Pat. No. 1,960,787 is for a golf club guiding system directing the club around a predetermined swing. The Sciarrillo U.S. Pat. No. 4,040,633 is a golf swing training machine supported by a base sitting on an angled surface and guides the golf club on a spiraled pipe guide. The U.S. Pat. No. 3,794,329 to Wilson is for a golf teaching apparatus in which the shaft of a golf club is attached to a sleeve which slides on a track to control the swing of a person practicing on the device. The Garland patent teaches an early mechanical golf teaching aid which also slides a shaft in a circular track. In the U.S. Pat. No. 3,744,799 to Hightower a golf practice device has a guiding track for teaching the proper technique for swinging a golf club.

SUMMARY OF THE INVENTION

The present invention relates to a golf training apparatus and especially to an apparatus having a frame with a base for sitting on the ground. A first arcuate golf club swing guide forms a ring and is attached to the frame for guiding a persons swing. A guide adjustment system allows for telescoping the frame for adjusting the position of the first club swing guide by adjusting the height, position and angle of the golf club swing guide. A second arcuate golf club swing guide is removably attached to the first golf club guide for guiding a persons swing thereon and is adjusted by adjusting the first arcuate golf club swing guide which thereby simultaneously adjusts the position of the second golf club swing guide and allows different size golfers to use the same device by the attachment and removal of the second smaller golf club swing guide. A person stands in position in the golf training apparatus and swings his club to slide along the golf club guide. The golf club guides can be made of a polymer and a polymer PVC pipe, if desired, with telescoping frame members for shifting the height and angular position of the arcuate golf club swing guides. Attachments are provided to the frame for a waist stand positioning, and wrist holding position. A putter guide attachment can be attached for practicing the swing of a putter. One telescoping member raises and lowers the arcuate golf club guides which can be locked in place with a pin while a second pair of telescoping frame members pushes the bottom portion of the first arcuate golf club swing guide to different positions and a third pair of telescoping frame members are attached to the top portion of the first arcuate golf club swing guide for adjusting the top portion relative to the bottom portion. Special attachments are made from pipe T-joints having a portion of one leg removed to allow it to snap onto another pipe and attach the second golf club swing guide to the first golf club swing guide.

BRIEF DESCRIPTION OF THE DRAWING

Other objects, features and advantages of the present invention will be apparent from the written description and the drawings in which:

FIG. 1 is a front elevation of a golf training apparatus in accordance with the present invention having a golfer positioned therein;

FIG. 3 is a sectional view taken on line 3—3 of FIG. 1;

FIG. 6 is a top plan view of the golf training apparatus of FIG. 1;

FIG. 7 is an exploded perspective view taken on circle 7 of FIG. 6;

FIG. 8 is a sectional view taken on line 8—8 of FIG. 7;

FIG. 9 is a side elevation of the golf training apparatus; and

FIG. 10 is a perspective view taken on circle 10 of FIG. 9.

DESCRIPTION OF THE PREFERRED EMBODIMENT

Figure 2:
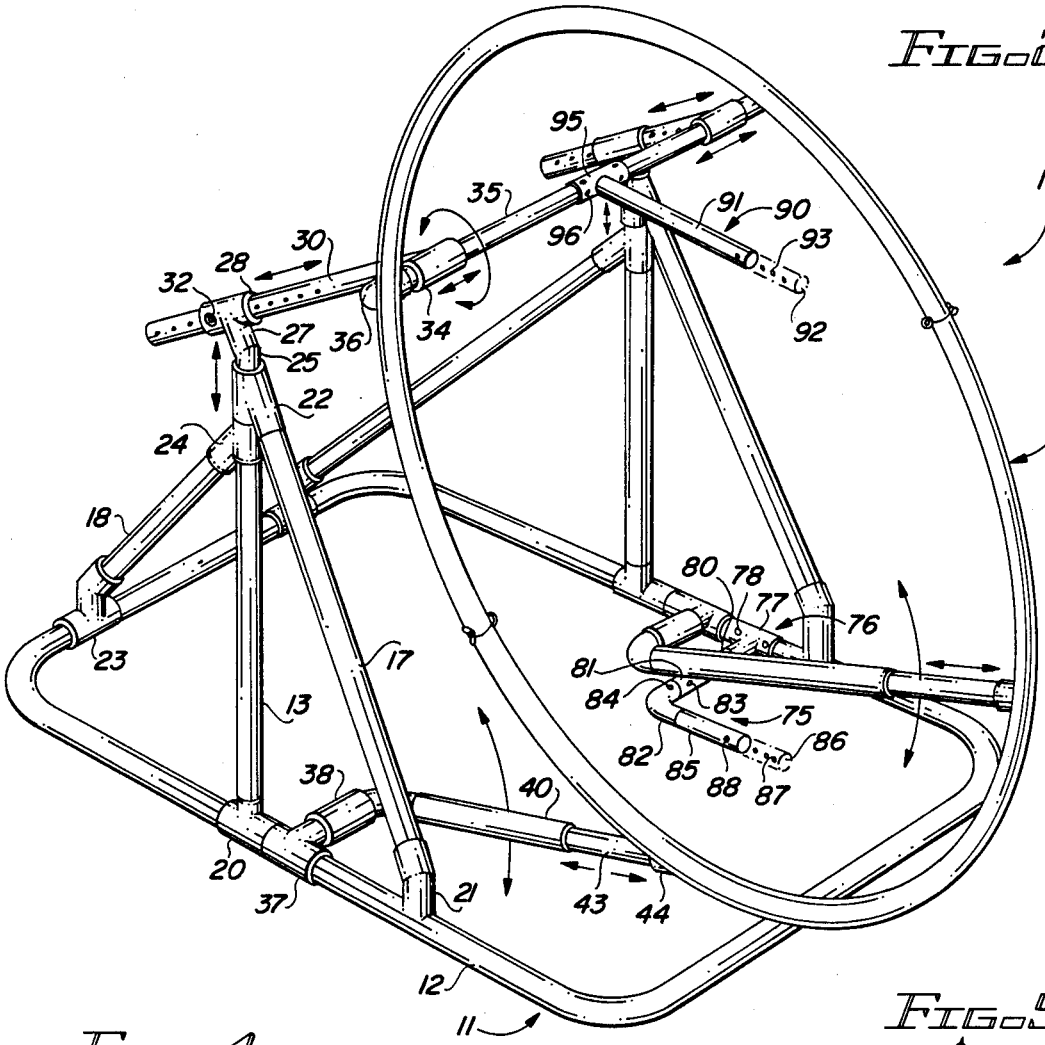
FIG. 2 is a perspective view of a golf club guide in accordance with FIG. 1.
Figure 4:
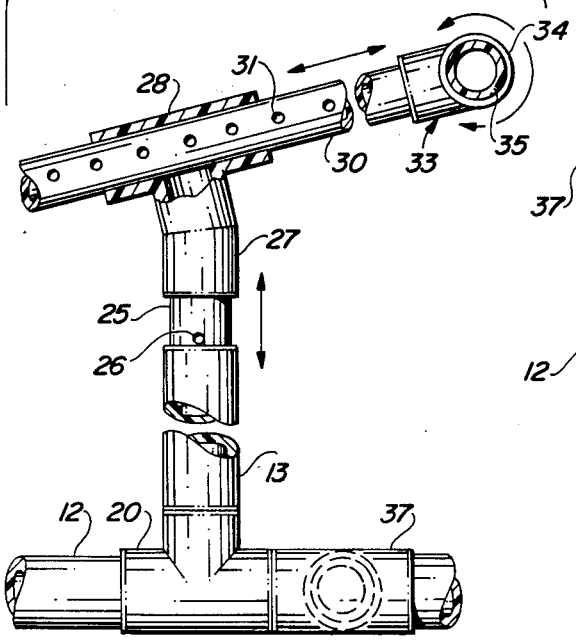
FIG. 4 is a partial side elevation of a pair of telescoping frame members.
Figure 5:
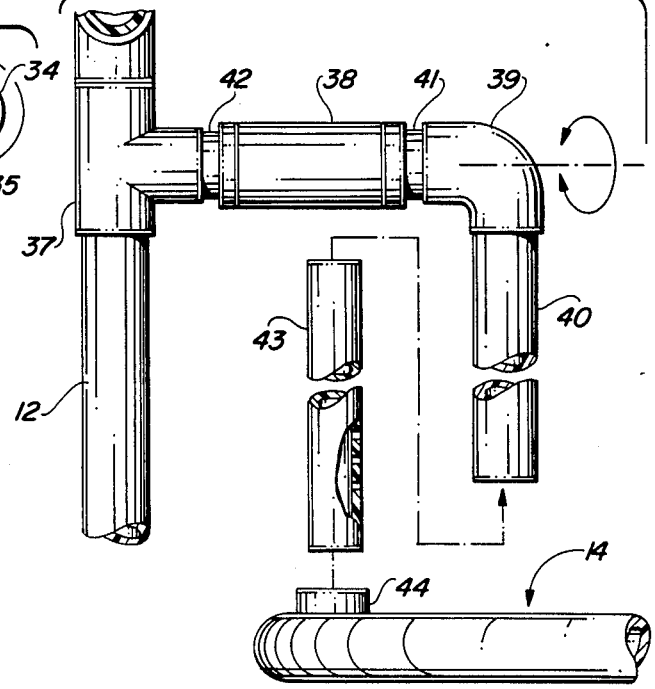
FIG. 5 is a partial top elevation of the frame coupling of the golf training apparatus of FIGS. 1 through 4.

Referring to the drawings and especially to FIGS. 1 through 5, a golf club training apparatus 10 has a frame 11 having a base portion 12 for sitting on the ground and a pair of vertically extending portions 13 extending from the base portion 12. The frame 11 supports a first arcuate golf club swing guide 14 attached to the frame for guiding the swing of a golfer 15 with a golf club 16. The golf club 16 is slid along the arcuate swing guide ring 14. The frame 11, in addition to the base 12 and vertical members 13, has a pair of angled upright extending frame members 17 and a second pair of angled frame member 18 connecting the base 11 to the upright vertical members 13 to rigidly support each vertical support frame member 13 in position. Each vertical frame member 13 is attached to a T-joint 20 in the frame base 12 while each frame member 17 is supported in a pipe joint 21 to the base 12. The other end of each member 17 is supported in a pipe joint 22. Each brace member 18 is connected to a pipe joint 23 to the base 12 of the frame 11 at one end and to a pipe joint 24 on each vertical frame member 13 at the other end thereof. Each one of a pair of telescoping frame members 25 telescope out of a vertical frame member 13 to any position desired. Apertures 26 in each frame member 25 allows for sliding a pin therethrough to lock the vertically sliding members 25 in position. Each vertical sliding member 25 has a coupling joint 27 attached thereto with a sleeve 28 for frame members 30 to slide in. Each frame member 30 has a plurality of apertures 31 for locking it in place with a pin 32 and is positioned at an angle as shown in FIGS. 2 and 4. The frame members 30 are at the same angle and telescope to the any desired position. Each frame member 30 has a T-joint 33 attached to one end thereof having a sleeve 34 for holding the golf club swing guide support bar 35. The support bar 35 can thereby rotate or move as the golf club swing guide 14 is shifted as the bar 30 is telescoped in and out. The bar 35 is attached at each end to the swing guide 14 so as not to interfere with the swing by means of a pipe coupling 36 which may also be formed out of a slotted piece of pipe. A pair of T-couplings 37 are formed in the base 12 of the frame 11 and each has a sleeve 38 on the protruding portion thereof having an elbow joint 39 connecting to an extension frame member 40 to allow each frame member 40 to be rotated in the sleeve 37. A small frame member 41 couples the elbow joint 39 to the sleeve 38 while frame member 42 couples the sleeve 38 to the T-joint 37. Each frame member 40 has a telescoping member 43 which slides in and out thereof and is coupled to a coupling 44 forming a part of the golf club swing guide 14.

At this point it can be seen that the golfer 15 can stand inside the frame 11 and place his golf club 16 on the arcuate golf club swing guide 14. A practice swing starts as shown in the phantom lines of FIG. 1 and continues along the guide 14. However, many different size golfers use different size golf clubs and require different size golf training devices. This problem as shown is solved in FIG. 9 by a second arcuate golf club swing guide 50 having a small ring or circle which may be made of a polymer pipe as illustrated in the figures and which may be conveniently adjusted by adjusting the larger golf club guide ring 14 by the telescoping of the vertical frame members 25 to raise or lower the top supporting frame members 30 and by telescoping the top supporting frame members 30 in and out to vary the position of the top portion of the swing guide 14 and by adjusting the angle by telescoping the lower support frame members 43 into and out of the frame member 40 to adjust the lower position of the swing guide 14 and smaller guide 50. The smaller swing guide 50 is attached to the larger guide with the coupling members 51 each having a pair of T-joints 52 and 53 connected by a sleeve 54. Each T-joint 52 has a portion 55 removed therefrom. The T-joint 53 has a portion 56 removed therefrom to allow it to be snapped onto the pipe of the smaller guide 50 and onto the pipe of the larger swing guide 14 on one end and onto the supporting bar 35 on the other end thereof. The small golf swing guide 50 when attached to the larger swing guide 14 can be readily adjusted by adjusting the larger guide.

Referring to FIG. 9, a putter guide bar 57 is attached directly to the bottom of either the large golf club guide 14 or to the small golf club swing guide 50 and has an elongated bar or pipe for guiding the putter in a straight line and is attached with a pair of slotted sleeves 58 which attached to the bottom of one of the guides 14 or 50 with an arm 60 to position the golf putting guide 57 in the proper position. The golf club swing guide 14 or 50 is lowered to the proper position for the putter guide but can allow practice with the putter at the same time as practicing golf swing.

The apparatus 10 also has a waist control belt 61 which wraps around the waist of a user and connects with a VELCRO fastener 62 and has a pair of attaching loops 63 thereon attaching a pair of resilient or bungie cords 64 which in turn attach to a pair of hooks 65 on the larger circular golf swing guide 14 to help control the movement of the waist of the person practicing his swings in the golf training apparatus 10. FIG. 8 is a sectional view taken through the larger tube along the line 8—8 of FIG. 7 of the larger golf club swing guide 14, both guide 14 and the smaller golf club guide 50 can be made by the bending of a PVC or polymer tube 65 into a circle and taking a small strip of tubing 66 having a cut out a portion 67 over the length of the section 66 to allow compression while sliding it into the tube 14 or 50 at the connecting position 68. The tube section 66 then expands inside tubes 14 or 50 for locking the guide in a circle. As more clearly shown in FIG. 7, the tube 66 has the slit 67 and is slid in the tube 14 and attached with a plurality of bolts 70 and wing nuts 71. The strip of pipe 66 is curved as well as having apertures 72 therethrough. Apertures 73 in the pipe 14 align with the apertures 72 for the bolts to pass through.

A knee kicker attachment 75 is seen in FIG. 2 connected to the base 12 of the frame 11 with a T-joint 76 having a sleeve 77 with bolt holes 78 in a protruding portion 80. The protruding portion 80 has a sleeve 81 attached thereto with an L-joint 82. A plurality of pin holes 83 are in the sleeve portion 81 while a plurality of pin holes 84 are in the elbow 82. The elbow is further connected to the arm 85 and has a telescoping piece of flexible Styrofoam 86 having a plurality of apertures 87 therein sliding in the tube 85 which has a single aperture 88 for locking the flexible Styrofoam knee kicker portion 86 in position. Thus, by sliding the sleeve 76 on the base 12 and rotating the elbow 82 on the sleeve 81, allows the positioning of the knee kicker can be adjusted for the particular golfer. In addition, the knee kicker can be attached to either side of base 12 for left or right hand golfers.

A head sway preventer mechanism 90 is shown in FIG. 2 and has a tube 91 thereon with a telescoping Styrofoam member 92 having a plurality of apertures 93 for locking in the tube 91 through the aperture 94. Tube 91 is attached to sleeve 95 having a plurality of apertures 96 therein and slides on bar 35 sleeve 77 but is positioned to place the Styrofoam insert 92 in a position to prevent head sway of the golfer. By sliding the sleeve 95 and telescoping the Styrofoam member, the head sway preventer can be positioned for a particular golfer of a particular height and position.

It should be clear at this time that a golf swing training apparatus has been provided which provides a swing guide for small and large golfers as well as left and right handed golfers and which has a variety of attachments for training the golfer. The apparatus can advantageously be made of a polymer, such as formed PVC tubing, as illustrated in the drawings but it should also be clear that it can be made of other molded or formed polymer parts without departing from the spirit and scope of the invention and is thus capable of being manufactured in an inexpensive manner for wide distribution. Accordingly, the present invention is not to be construed as limited to the forms shown which is to be considered illustrative rather than restrictive.

I claim:

1. A golf training apparatus comprising:

a frame having a base for sitting on the ground;

a first golf club swing guide attached to said frame, said first golf club swing guide for guiding a person's swing;

guide adjustment means for adjusting the position of said golf club swing guide, said guide adjustment means having a height and angle adjustment for said golf club swing guide;

a second golf club swing guide removably attachable to said first golf club swing guide for guiding a person's swing, said second golf club swing guide being adjusted by said guide adjustment means adjusting said first golf club swing guide with said second golf club swing guide attached thereto; whereby said guides allow different size golfers and different size clubs to be used thereon.

2. A golf training apparatus in accordance with claim 1 in which said first golf club swing guide is an arcuate polymer pipe.

3. A golf training apparatus in accordance with claim 2 in which said second golf club swing guide is an arcuate polymer pipe.

4. A golf training apparatus in accordance with claim 3 in which said first and second golf club swing guides are arcuate P.V.C. pipe.

5. A golf training apparatus in accordance with claim 4 in which said first and second golf club swing guides form complete circles.

6. A golf training apparatus in accordance with claim 1 including a waist band attachment attached to said frame and having a removable waist band.

7. A golf training apparatus in accordance with claim 6 including a waist band attachment having hook and loop belt fasteners and is attached to said frame with resilient cords.

8. A golf training apparatus in accordance with claim 1 including a putter guide attachment removably attachable to said first golf club swing guide for guiding a putter therealong.

9. A golf training apparatus in accordance with claim 1 in which said frame has a pair of vertically extending telescoping members for adjusting the height of said first and second golf club swing guides.

10. A golf training apparatus in accordance with claim 9 in which said frame pair of vertically extending upright members each has telescoping frame members having apertures therein and pin locks for locking said upright members in position.

11. A golf training apparatus in accordance with claim 10 in which said frame has a pair of angled front members attached to said first golf club swing guide along the bottom portion thereof and telescoping on said frame to move said first golf club swing guide relative to said frame.

12. A golf training apparatus in accordance with claim 11 in which said frame has a pair of angled front members attached to a bar extending across said first golf club swing guide and attached thereto along the top portion thereof and telescoping on said frame to move said first golf club swing guide relative to said frame.

13. A golf training apparatus in accordance with claim 1 including a knee kicker attached to the frame thereof and protruding from the frame to bump a persons knee upon said knee being moved into the knee kicker during a practice golf swing.

14. A golf training apparatus in accordance with claim 1 including a knee kicker attached to the frame thereof and having a telescoping expanded synthetic resin member telescoping therefrom and having opening therein for locking said telescoping expanded synthetic resin member in position adjacent the knee of a user by the insertion of pins through said apertures.

15. A golf training apparatus in accordance with claim 14 including a head sway prevention means for preventing the user of said golf training apparatus from moving during a practice swing.

16. A golf training apparatus in accordance with claim 15 in which said head sway prevention means is adjustably attached to a frame member extending between said vertically extending members.

17. A golf training apparatus in accordance with claim 1 in which said second golf club swing guide is an attached to said first golf club swing guide with a plurality of attachment arms each said arm having a T-joint on one end having a slotted portion removed therefrom to allow a snap fastening to a polymer pipe.

* * * * *